US005102199A

United States Patent [19]

LeBegue

[11] Patent Number: 5,102,199

[45] Date of Patent: Apr. 7, 1992

[54] CONTINUOUS MINING MACHINE WITH A BOOM ASSEMBLY PROVIDING DIFFERENT CUTTING HEIGHTS AND METHOD OF CONVERTING

[75] Inventor: Maurice K. LeBegue, Fairmont, W. Va.

[73] Assignee: Tamrock World Corporation, N.V., Curacao, Netherlands Antilles

[21] Appl. No.: 641,871

[22] Filed: Jan. 16, 1991

[51] Int. Cl.[5] ..... E21C 25/08; E21C 31/10

[52] U.S. Cl. ..... 299/10; 299/76

[58] Field of Search ..... 299/75, 76, 78, 95, 299/10

[56] References Cited

U.S. PATENT DOCUMENTS 4,921,309 5/1990 Harrison ..... 299/75

FOREIGN PATENT DOCUMENTS 53867 10/1974 Australia ..... 299/76
3427962 1/1986 Fed. Rep. of Germany ..... 299/76
2124407 2/1984 United Kingdom ..... 299/76

*Primary Examiner*—David J. Bagnell
*Attorney, Agent, or Firm*—Stanley J. Price, Jr.

[57] ABSTRACT

A self propelled continuous mining machine includes a mobile frame assembly having a first pivot point for a boom assembly or an end of a piston cylinder assembly and a second pivot point for pivotally connecting an end of a piston cylinder assembly or pivotally connecting an end portion of a lever member which may be interchangeably utilized to provide the continuous mining machine with boom assemblies of different cutting heights. The first pivot point is located at an elevation higher than the elevation of the second pivot point. This arrangement of interchangeable boom pivot points permits for low and high cutting height boom assemblies to be utilized with the same continuous mining machine.

9 Claims, 1 Drawing Sheet

CONTINUOUS MINING MACHINE WITH A BOOM ASSEMBLY PROVIDING DIFFERENT CUTTING HEIGHTS AND METHOD OF CONVERTING

BACKGROUND OF THE INVENTION

1. Field of the Invention

This invention relates to a mining machine, and more particularly, to a mining machine that includes a mining machine frame having a plurality of pivots for a boom assembly and for piston cylinder assemblies with the piston cylinder assemblies being positioned selectively at the respective pivot points to provide mining machine boom assemblies having different cutting heights which may be utilized with the same continuous mining machine.

2. Description of the Prior Art

It is well known in underground mining to provide mining machines with adjustable cutting means and pivotally secured boom assemblies movable by means of pivotally secured piston cylinder assemblies.

U.S. Pat. No. 2,282,704 discloses a vehicle for gathering and carrying mined material and having a detachable loading head. The detachable loading head is laterally movable on the main frame of the vehicle, and is secured to the vehicle by upwardly projecting apertured brackets on a platform supporting the gathering head to which apertured arms are pivotally connected to the loading head by pins.

U.S. Pat. No. 2,866,626 discloses a mining machine having two rows of cutter heads hydraulically movable on a vertical axis away from each other and inclinable relative to the axis of the frame carrying the cutting heads, and being supported on a boom assembly which is vertically movable relative to the axis of the mining machine frame.

U.S Pat. No. 2,868,531 discloses a cutter head for a mining machine having an adjustable cusp cutter.

U.S. Pat. No. 3,013,784 discloses a mining machine having an adjustable head mechanism movable in the vertical and horizontal planes. Gearing allows for movement of the cutter head around the axis of the drive shaft while the cutter head rotates.

U.S. Pat. No. 3,208,797 discloses a continuous mining machine having a cutter frame structure supported on three points, two of which points are cylinders mounted on either side of the cutter frame with pistons having balls fitting into sockets, and the third point being an universal joint. The cutter frame structure is adjustable with respect to the vertical and transverse longitudinal axes of the mining machine frame.

U.S. Pat. Nos. 3,730,593 and 3,774,969 as well as 3,848,930 and 4,056,189 disclose a boom member pivotally connected to the frame of a continuous mining machine by means of rearwardly extending parallel arm members. The arm members are pivotally connected to a piston rod of a piston cylinder assembly which is pivotally connected at its other end to the mining machine frame. Retraction of the piston rod of the piston cylinder assembly pivots the boom member vertically about the pivot point of the arms connected to the boom member.

U.S. Pat. No. 4,076,316 discloses a boom member pivotally connected to the frame of the mining machine by means of arm members. A pair of parallel support members are positioned laterally of the boom arm members and extend forwardly therefrom. The support members are supported on cylindrical members which extend laterally from the ar members and whose rearward end portions have a cylindrical recess arranged to receive the cylindrical members to allow the support members to move laterally toward and away from the arm members.

U.S. Pat. No. 4,088,371 discloses a continuous mining machine with a forwardly extending boom member having parallel rearwardly extending arm members which are pivotally connected to the mining machine frame. A piston rod of a piston cylinder assembly is pivotally connected to the arm members and the other end of the piston cylinder assembly is pivotally connected to the mining machine frame. Extension and retraction of the piston rod effects vertical movement of the boom member around the pivot point of the boom member.

There are other examples in the prior art of a boom member pivotally secured to the mining machine frame of a continuous mining machine, and movable relative to the mining machine frame around the pivot point of the boom assembly by means of a piston cylinder assembly pivotally connected to the boom member and also pivotally connected to the mining machine. Recent examples of this type of boom assembly for a continuous mining machine may be seen in U.S. Pat. No 4,641,888 and U.S. Pat. No. 4,582,363.

Although the prior art discloses adjustable cutter frame assemblies, and pivotally secured boom assemblies movable about a vertical plane by means of pivotally secured piston cylinder assemblies, there remains a need for a boom assembly having interchangeably functional dual pivot points for receiving either the boom assembly structure pivotally thereon, or a piston cylinder assembly pivotally thereon to enable the continuous mining machine frame assembly to accomodate either a relatively low cutting height boom assembly or a relatively higher cutting height boom assembly.

SUMMARY OF THE INVENTION

In accordance with the present invention, there is provided a continuous mining machine for use in an underground mine which includes a mobile frame assembly, and a material dislodging means extending from the mobile frame assembly.

The mobile frame assembly has an upper pivot point and a lower pivot point positioned on the front end thereof to provide a means for pivotally securing the boom assembly and the piston cylinder assembly which raises and lowers the boom assembly. Either pivot point may be utilized to pivotally secure either the boom assembly or the piston cylinder assembly. Thus, two types of booms can be installed on this mining machine frame.

The first boom, designated a top pivot boom, is pivotally secured to the upper pivot point and a piston cylinder assembly is connected to the lower pivot point on the frame of the continuous mining machine. The piston cylinder assembly is pivotally secured to the boom arm structure at a location intermediate the material dislodging means and the boom assembly pivot point. With this arrangement, when the piston cylinder assembly is extended, the top pivot boom assembly reaches a high cutting height and when the piston cylinder is retracted, the boom assembly is in its lower position as illustrated. With this pivot arrangement, in addition to reaching a high cutting height, there is also a minimal shift of the material disloding means center of gravity as it is rotated about the boom assembly pivot point with a minimal arcuate trajectory.

A second boom structure can be utilized in which the boom assembly is pivotally connected to the lower pivot point of the mining machine frame by an arm member connected to the boom assembly. The movement of the bottom pivot boom is actuated by a piston cylinder assembly which is pivotally connected to the upper pivot point on the mining machine frame. The piston cylinder assembly is connected at its other end to a pivot point on the arm member to the boom assembly as by a clevis. With the boom assembly connected to the mining machine frame in this manner, the boom assembly is elevated by the retraction of the piston in the piston cylinder assembly, and the boom assembly is lowered by the extension of the piston in the piston cylinder assembly. Since the elevation of the boom assembly is limited by the extent of retraction of the piston in the piston cylinder assembly, the boom assembly utilizing the lower pivot point has a relatively low cutting height and a relatively larger shift of the center of gravity due to the arcuate movement of the material dislodging means.

Accordingly, the principal object of the present invention is to provide a continuous mining machine which includes dual pivot points which may be used interchangeably to pivotally connect either a piston cylinder assembly or the boom assembly to the mining machine frame to conveniently provide the continuous mining machine with either a low cutting height boom assembly or a high cutting height boom assembly.

These and other objects of the present invention will be more completely disclosed and described in the following specification, the accompanying drawings and the appended claims.

DESCRIPTION OF THE PREFERRED EMBODIMENTS

Figure 1:
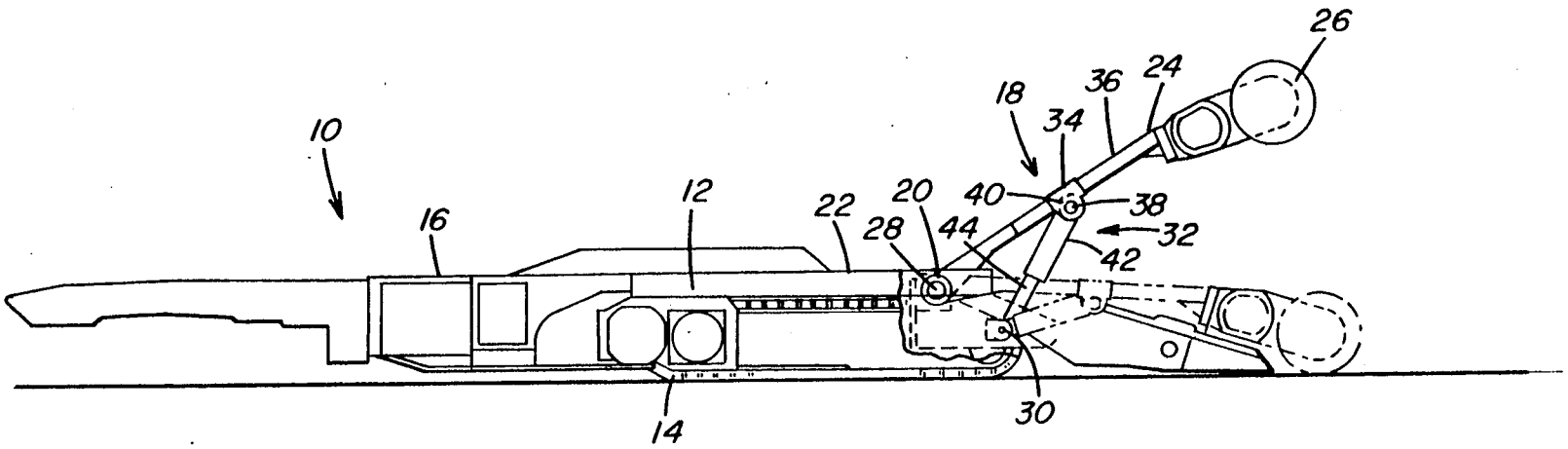
FIG. 1 is a view in elevation of the continuous mining machine, and illustrating a boom assembly pivotally connected to a top pivot point and a piston cylinder assembly pivotally connected to the bottom pivot point and with the boom in phantom in the lowered position.

Referring to the drawings, there is illustrated a continuous mining machine generally designated by the numeral 10 for use in an underground mine to dislodge material from the mine face. Continuous mining machine 10 includes a mobile frame assembly 12 and a pair of ground engaging traction means 14 positioned at each side of mobile frame assembly 12 for propelling mining machine 10 within a mine.

Continuous mining machine 10 is capable of being operated from an operating station in a manner similar to other such machines to dislodge material from the mine face and to transport it rearwardly of the rear end 16 of mining machine 10. Accordingly, mining machine 10 includes operating controls and sources of power for operating the ground engaging traction means 14 and other equipment included thereon.

Mining machine 10 includes a boom assembly generally designated at numeral 18 having a first end portion 20 secured to the front end 22 of mobile frame assembly 12. Boom assembly 18 also includes a second end portion 24. As seen in the drawings, a material dislodging head 26 is connected to the second end portion 24 of the boom assembly 18. Although a material dislodging head such as dislodging head 26 is illustrated in the figures it should be understood that any desired dislodging mechanism known in the art may be utilized.

Referring to the embodiment in FIG. 1, there is illustrated the continuous mining machine 10 connected to boom assembly 18 by means of a top pivot point 28. Top pivot point 28 pivotally secures boom assembly 18 to the mobile frame 12 of the continuous mining machine 10. A lower pivot point 30 serves as an anchor for the piston of a piston cylinder assembly generally designated a 32. The cylinder 42 is pivotally secured to an ear 34 extending from a portion of the boom arm 36 intermediate the upper pivot point 28 and the material dislodging means 26. The ear 34 on the boom arm 36 has a pin 38 extending therethrough to pivotally secure the pivot connection 40 extending from the top portion of the cylinder 42. When the piston 44 of the piston cylinder assembly 32 is extended from the cylinder 42, the boom assembly 18 is vertically elevated around the axis of the boom pivot point 28.

With this arrangement of the piston cylinder assembly 32 connected to an intermediate portion of the boom arm 36 and the boom assembly 18 pivotally secured to the upper pivot point 28, there is a minimal shift in the center of gravity as the boom arm 18 is rotated generally vertically. This arrangement also allows for a relatively high cutting height as the material dislodging head 26 may be extended upwardly to a relatively high elevation.

Figure 2:
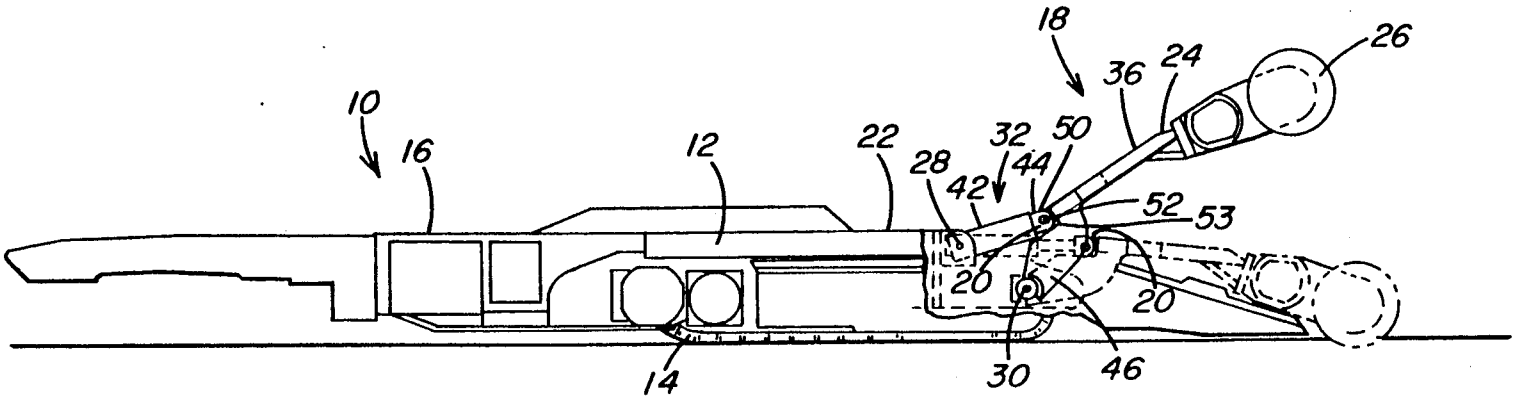
FIG. 2 is another view in elevation of the continuous mining machine with a boom assembly pivotally connected to the bottom pivot point and a piston cylinder assembly pivotally connected to the top pivot point and with the boom in phantom in the lowered position.

In the embodiment illustrated in FIG. 2, the boom assembly 18 is pivotally secured to lower pivot point 30 by means of a rearwardly extending arm o lever 46 which is secured to the first end 20 of the boom assembly 18. A piston cylinder assembly generally designated at 32, has a pivot connection on the cylinder 42 to pivotally connect the cylinder 42 to the upper pivot point 28 on the front end 22 of the mining machine 10. The piston 44 extending from the cylinder 42 has a pivot connection on its end portion 50 to receive a pin 52 to pivotally secure piston 44 to a clevis 53 on the boom arm 36. As illustrated in FIG. 2, when the piston 44 is extended, the boom arm 36 is pushed forward and the boom assembly 18 is lowered. When the piston 44 is retracted into the cylinder 42, the boom arm 36 is pulled by the piston 44 and the boom assembly 18 is raised. As illustrated in FIG. 2, the extent of movement of the boom arm 36 about the lower pivot point 30 is limited by the length of the piston 44 which can be withdrawn into the cylinder 42, thus the boom assembly connected to the mobile frame 12 of the continuous mining machine 10 is in this manner limited to a relatively low cutting height. Since the piston 44 is connected to the first end 20 of the boom assembly 18, a relatively arcuate movement of the material dislodging means 26 causes a larger shift in the center of gravity than with the arrangment shown in the embodiment of FIG. 1.

According to the provisions of the Patent Statutes, I explained the principal, preferred construction and mode of operation of my invention and have illustrated and described what I now consider to represent its best embodiments. However, it should be understood that within the scope of the appended claims, the invention may be practiced otherwise than as specifically illustrated and described.

I claim:

1. A continuous mining machine comprising, an elongated frame member mounted on a propelling means, said frame member having a front end portion and a rear end portion, a boom member extending forwardly of said frame member front end portion, said boom member having a first end portion and a second end portion, a material dislodging means mounted on said second end portion of said boom member, a piston cylinder assembly extending between said boom member and said frame member to effect raising and lowering of said boom member, and a first pivot means on said frame member for pivotally receiving in one mode said first end portion of said boom member and alternatively pivotally receiving in a second mode one end portion of said piston cylinder assembly being connected at an opposite end portion to said boom member first end portion to provide a mining machine having different cutting heights.

2. A continuous mining machine as set forth in claim 1 which includes, a lever, second pivot means on said frame member for pivotally receiving an end portion of said lever, and said lever other end portion being connected to said first end portion of said boom to provide the mining machine with a lower dislodging height.

3. A continuous mining machine as set forth in claim 2 which includes, said second pivot means including a second pivot point on said frame member, and said piston cylinder assembly pivotally connected at said one end portion to said frame member at said second pivot point and at said opposite end portion to an intermediate portion of said boom member to provide the mining machine with a high dislodging height.

4. A continuous mining machine as set forth in claim 1 which includes, said piston cylinder assembly pivotally connected at said one end portion on said machine frame to said first pivot means and pivotally connected at said opposite end portion to said first end portion of said boom member to provide the mining machine with a lower dislodging height.

5. A continuous mining machine as set forth in claim 1 which includes, said first pivot means including a first pivot point on said frame member, and said first end portion of said boom member pivotally connected to said frame member at said first pivot point to provide the mining machine with a high dislodging height.

6. A continuous mining machine as set forth in claim 1 in which, said first pivot means includes a first pivot point on said frame member, and a second pivot point on said frame member, said first pivot point located above said second pivot point.

7. A continuous mining machine as set forth in claim 6 in which, said first pivot point is arranged to alternatively pivotally receive said first end portion of said boom member and said one end portion of said piston cylinder assembly.

8. A continuous mining machine as set forth in claim 6 in which include, a lever, said second pivot point is arranged to alternatively pivotally receive said one end portion of said piston cylinder assembly and an end portion of said lever connected to said first end portion of said boom member.

9. A method of converting a mining machine from a machine having a high dislodging height to a machine having a low dislodging height comprising the steps of, removing an end portion of a boom member pivotally connected at a first pivot point on a mining machine frame member and removing an end portion of a piston cylinder assembly pivotally connected to said frame member at a second pivot point;

connecting an end portion of a lever to said end portion of said boom member, pivotally connecting the other end portion of said lever to said frame member at said second pivot point, and pivotally connecting said end portion of said piston cylinder assembly to said frame member at said first pivot point and the other end to said end portion of said boom member.

* * * * *